United States Patent [19]

Arnseson

[11] Patent Number: 4,909,175

[45] Date of Patent: Mar. 20, 1990

[54] BOAT WITH TRIMMABLE BOTTOM

[76] Inventor: Howard M. Arnseson, 18 Sagebrush Ct., San Rafael, Calif. 94901

[21] Appl. No.: 254,540

[22] Filed: Oct. 5, 1988

[51] Int. Cl.[4] ..... B63B 1/28

[52] U.S. Cl. ..... 114/285; 114/286

[58] Field of Search ..... 114/284, 285, 286, 287

[56] References Cited

U.S. PATENT DOCUMENTS

| | | | |
|---|---|---|---|
| 1,779,075 | 10/1930 | Plum . | |
| 2,816,521 | 12/1957 | Alexander | 114/66.5 |
| 3,002,485 | 10/1961 | Curtis | 114/285 |
| 3,058,442 | 10/1962 | Curtis | 114/285 |
| 3,370,561 | 2/1968 | Ilon | 114/285 |
| 3,371,642 | 3/1968 | Joy | 114/285 |
| 3,463,109 | 8/1969 | Weiler | 114/285 |
| 3,530,816 | 9/1970 | Mitchell | 114/66.5 |
| 3,577,948 | 5/1971 | Frey | 114/66.5 |
| 3,601,078 | 8/1971 | Bedford | 114/66.5 |
| 3,678,874 | 7/1972 | Flink | 114/285 |

FOREIGN PATENT DOCUMENTS

| | | | |
|---|---|---|---|
| 264064 | 10/1963 | Australia . | |
| 50740 | 9/1970 | Australia . | |
| 940389 | 1/1974 | Canada | 114/285 |
| 499804 | 2/1920 | France | 114/285 |
| 2250663 | 6/1975 | France . | |

*Primary Examiner*—Sherman D. Basinger
*Assistant Examiner*—Stephen P. Avila
*Attorney, Agent, or Firm*—Townsend and Townsend

[57] ABSTRACT

A resilient trim plate which, when mounted in cantilever fashion on the bottom of a boat and when adjusted, provides for trimming of the boat when the boat is underway and moves over the water. The trim plate is provided with fasteners for rigidly securing the forward portion of the trim plate to the bottom of the boat at a location forwardly of the transom or aft end of the boat. The trim plate extends rearwardly from the attachment means in cantilever fashion and presents a curved or convex lower surface to the water. The curvature of the lower surface of the trim plate can be increased or decreased to thereby increase or decrease the pressure difference between the upper and lower surfaces of the trim plate when the boat is moving over the water. Such pressure difference generates a downward force on the trim palte and thereby the boat much in the same manner the creation of a lift force as air flows over the wing of an airplane in flight. In effect, therefore, fluid flow past the trim plate provides a downward fluid force on the trim plate and thereby the boat because of the specific curvature of the lower surface of the trim plate. Adjusting members are provided to cause the curvature of the lwoer surface of the trim plate to be adjustable. These adjusting members can be of any suitable construction, such as manually adjustable turnbuckles, electrically adjustable power device, and fluid actuated power units. These adjusting members can be adjusted before or after movement of the boat through the water.

10 Claims, 2 Drawing Sheets

FIG. 4
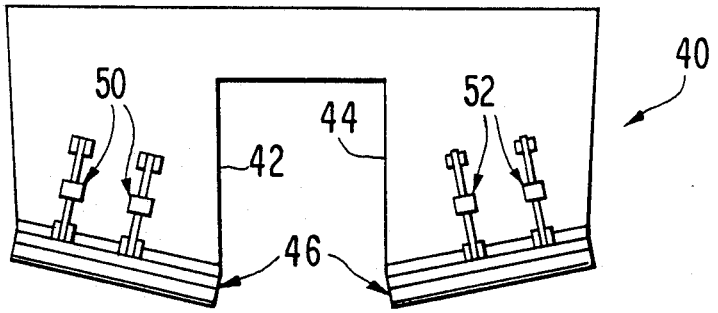
FIG. 5
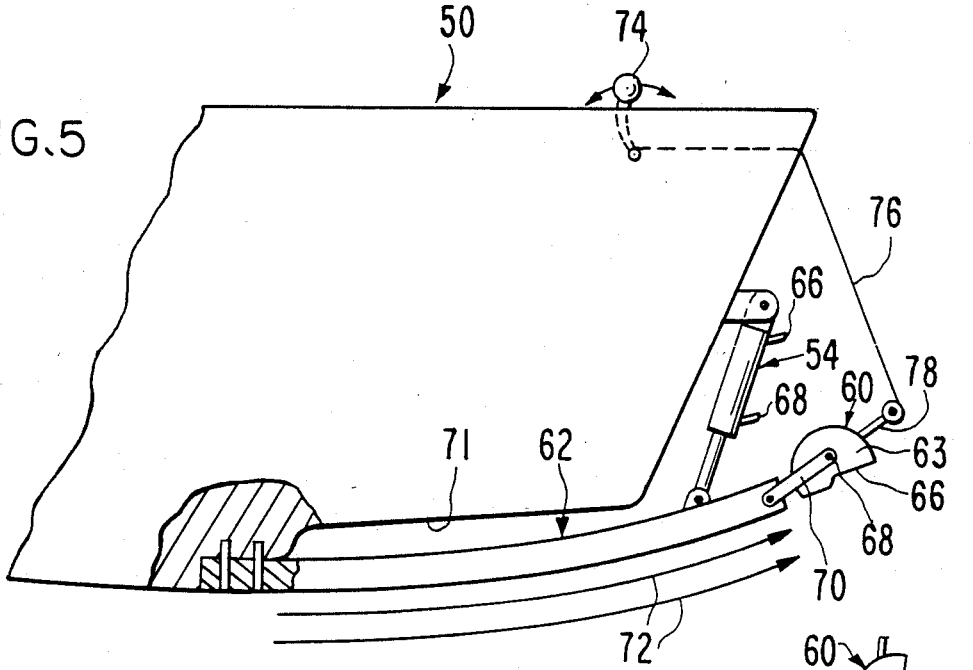
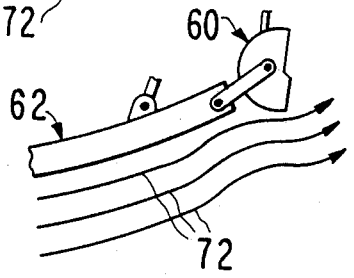
FIG. 7
FIG. 6
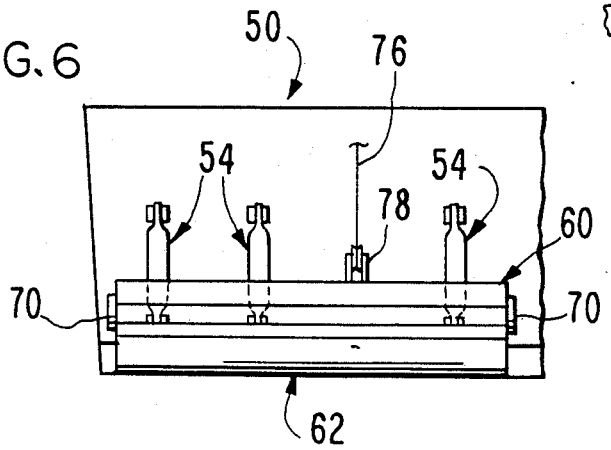

BOAT WITH TRIMMABLE BOTTOM

BACKGROUND OF THE INVENTION

1. Field of the Invention

This invention relates to improvements in boats and, more particularly, to a boat having a trim plate which serves to provide a trimmable bottom portion for the boat.

2. Description of the Prior Art

In operating a boat, it is desirable to have control of the bow of the boat so that the bow will not ride up too high to cause instability of the boat or to ride too low in the water to cause excessive drag forces on the boat. Attempts have been made to use tabs, flaps and the like to stabilize boats. Some of those attempts are disclosed in U.S. Pat. Nos. 2,816,521, 3,530,816, 3,601,078, 3,678,874, 1,779,075, 3,577,984, 3,718,642, 3,678,874, German Patent 357644, French Patents 458807 and 2250663 and Australian Patents 264064 and 50740. For the most part, these patents disclose flaps and tabs which are satisfactory only to a limited extent in trimming a boat as the boat is under way. Because of the drawbacks of conventional flaps and tabs, a need exists for improvements in the way in which a boat is trimmed when the boat is moving through the water. The present invention satisfies this need.

SUMMARY OF THE INVENTION

The present invention provides a resilient trim plate which, when mounted in cantilever fashion on the bottom of a boat and when adjusted, provides for trimming of the boat when the boat is underway and moves over the water. To this end, the trim plate of the present invention is provided with fasteners for rigidly securing the forward portion of the trim plate to the bottom of the boat at a location forwardly of the transom or aft end of the boat so that the trim plate can extend rearwardly from the attachment means in cantilever fashion and can present a curved or convex lower surface to the water.

The curvature of the lower surface of the trim plate can be increased or decreased to thereby increase or decrease the pressure difference between the upper and lower surfaces of the trim plate when the boat is moving over the water. Such pressure difference can generate a downward force on the trim plate and thereby the bat much in the same manner the creation of a lift force is air flows over the wing of an airplane in flight. In effect, therefore, fluid flow past the trim plate provides a downward fluid force on the trim plate and thereby the boat because of the specific curvature of the lower surface of the trim plate.

Adjusting members are provided to cause the curvature of the lower surface of the trim plate to be adjustable. These adjusting members can be of any suitable construction, such as manually adjustable turnbuckles, electrically adjustable power device, and fluid actuated power units. These adjusting members can be adjusted before or after movement of the boat through the water.

The present invention is suitable for use with different types of boats, such as power boats, cruisers, catamarans and trimarans. The trim plate itself can be of suitable resilient material, such as stainless steel, aluminum, fiberglass or a matrix of carbon fibers.

The primary object of the present invention is to provide an improved trim plate having a fastening means for rigidly securing the trim in cantilever fashion to the bottom of a boat, whereby the trim plate presents a curved lower surface which can be adjusted in curvature to provide for a greater or lesser amount of downward force exerted on the rear portion of the boat.

Another object of the present invention is to provide a boat having a trim plate on the bottom thereof in a cantilever fashion with the trim plate having a curved lower surface, whereby the attitude of the bow of the boat can be adjusted by adjusting the curvature of the lower surface of the trim plate to thereby provide for greater control of the boat as it moves over the water.

Other objects of this invention will become apparent as the following specification progresses, reference being had to the accompanying drawings for an illustration of the invention.

BRIEF DESCRIPTION OF THE DRAWINGS

FIG. 4 is a view similar to FIG. 3, but showing the aft end of a catamaran boat;

FIG. 5 is a view similar to FIG. 2, but showing a spoiler device on the aft end of the trim plate;

FIG. 6 is a view similar to FIG. 3, but showing the way in which the spoiler device is mounted on the aft end of the trim plate;

FIG. 7 is a view similar to FIG. 5, but showing the spoiler in operation to destroy laminar flow of water past the trim plate.

DETAILED DESCRIPTION OF THE PREFERRED EMBODIMENTS

Figure 1:
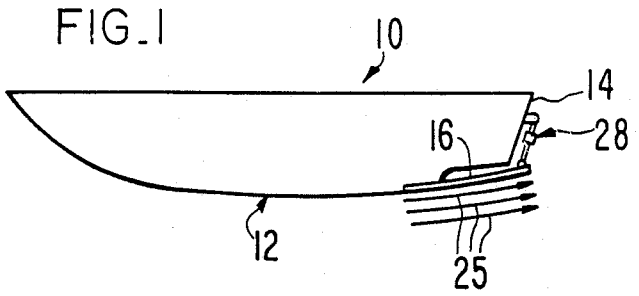
FIG. 1 is a side elevational view of a boat having a trim plate on the aft portion of the boat near the transom to form a trimmable bottom for the boat.

A boat using the trim plate of the present invention is broadly denoted by the numeral 10 and includes a bottom 12 and a transom 14 as is conventional. Typically, the bottom of the boat 12 has two sloping surfaces 12*a* and 12*b* as shown in FIG. 1*a*. However, the boat could have a flat bottom surface instead of the sloping surfaces 12*a* and 12*b*. The boat can be a motorboat either with an outboard motor or an inboard motor, it could be a high speed boat, a cruiser or a patrol boat. Moreover, it could be a catamaran or a trimaran boat. For purposes of illustration, boat 10 will be described hereinafter as having the sloping bottom surfaces 12*a* and 12*b* as shown in FIG. 1*a*.

Boat 10 is provided with a pair of trim plates 16 which are substantially identical in size, shape and construction. There is a trim plate 16 for each of surfaces 12*a* and 12*b*, respectively. Each trim plate typically is a resilient, plate-like member which has a forward part 17, a rear part 19, and a convex lower surface portion 26 near rear part 19.

A typical material for the trim plate is stainless steel, but it could be of plastic, fiberglass, aluminum or carbon fibers. For example, a stainless steel trim plate could typically have a thickness of ¼ inch to ½ inch and a length from portion 17 to portion 19 of 3 to 5 feet for a power boat of average size. If, for instance, the trim plate is formed of fiberglass or plastic material, it could be molded so that the trim plate is integral with boat 10.

Figure 1A:
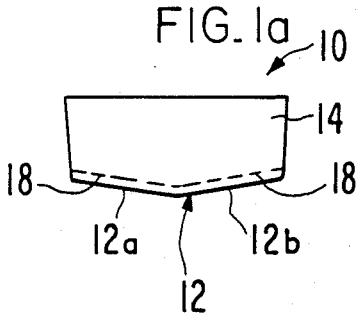
FIG. 1*a* is a rear elevational view of the boat without the trim plate.
Figure 2:
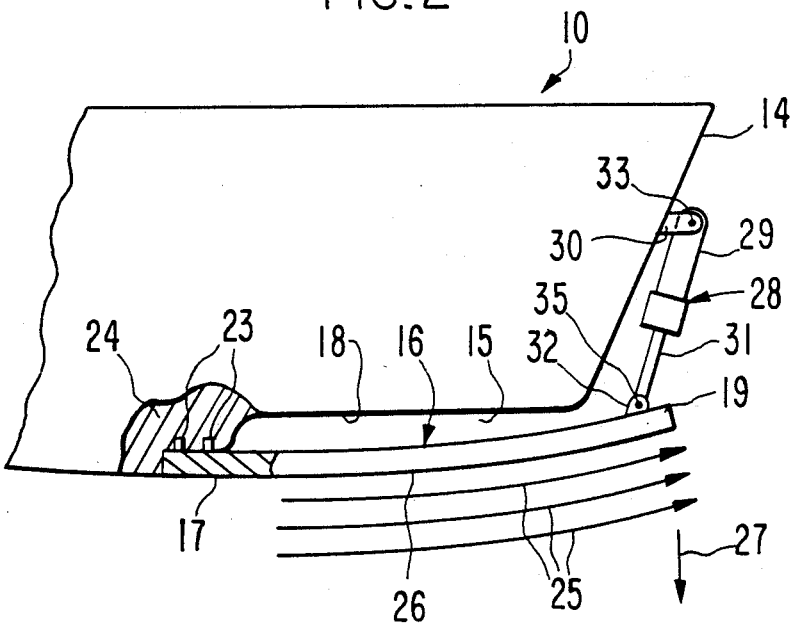
FIG. 2 is an enlarged, fragmentary view of the boat showing the trim plate and an adjustable power device coupled the aft end of the trim plate to the transom, parts being broken away and in section to illustrate details of construction.
Figure 3:
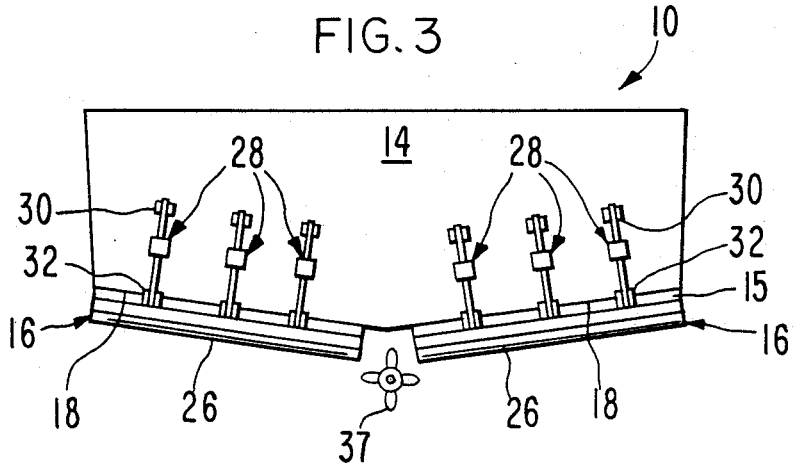
FIG. 3 is a rear elevational view of the boat, showing a pair of trim plates on both sides of the center line of the boat.

Bottom 12 is formed or worked to present a pair of rear or aft bottom surfaces 18 as shown in FIGS. 1*a* and 3, there being a surface 18 for each of surfaces 12*a* and 12*b*, respectively. Typically, surfaces 18 will be parallel to respective surfaces 12*a* and 12*b*, but will be offset vertically by a certain distance, such as 2–4 inches. Surfaces 18 are above a first recess 15 (FIG. 2) above the trim plates 16. A second recess 21 is provided for each bottom surface 12*a* or 12*b* near the forward end of each surface 18. The height of each second recess 21 is substantially equal to the thickness of portion 17 of the corresponding trim plate 16.

Each forward portion 17 of each trim plate 16 is received within the corresponding second recess 21 and secured to the boat by fasteners 23 which can typically be threaded bolts which are threaded into the bottom portion 24 of the boat (FIG. 2). Thus, each trim plate is cantilevered from the forward end thereof. When so mounted in the recess 21, the bottom surface portion 17 of each trim plate 16 will be substantially coextensive or flush with the respective bottom surface 12*a* or 12*b* of bolt 10 so that there will be no discontinuity at the junction there-between. Thus, as the boat moves forwardly in the water, there will be no turbulence of the water flow in the vicinity of the junction between surfaces 12*a* and the bottom surface of portion 17. The water will flow essentially in laminar flow as identified by streamlines 25 (FIG. 2) which are essentially parallel to and move without interruption along the bottom surface of the trim plate throughout the length of the trim plate.

The bottom surface 26 of the trim plate 16 is convex throughout substantially the length of the surface 26 from the forward end to the aft end as shown in FIG. 2. Thus, plate 16 presents an air foil-like appearance to the streamlines 25 so that the streamlines, as they low along surface 26, will act like an air foil on an airplane to generate a fluid pressure difference above and below the trim plate and such pressure difference will cause the rear portion 19 of the trim plate and thereby the aft end of the boat, to experience a downward force indicated by arrow 27 (FIG. 2) which will tend to raise the bow of the boat. Typically both trim plates 16 of boat 10 will be identical in curvature near the rear portions 19 of the trim plate so that the boat will uniformly be trimmed for the bow up or bow down condition which is desired by the operator of the boat.

A number of power devices are provided on the transom 14 of the boat and connected to each trim plate, respectively, for adjusting the trim plate curvature of surface 26 of the respective trim plate 16. Such power devices are denote by the numeral 28 and are adjustable to vary the effective lengths of the devices 28. For purposes of illustration, each device 28 comprises a turnbuckle which has an upper part 29 pivotally coupled by a pin 33 to an ear 30 secured to transom 14. A second member 31 on a turnbuckle is pivotally coupled by a pin 35 to an ear 32 secured to the upper surface of the trim plate near aft portion 19 thereof. Thus, to create a greater curvature of the trim plate, the effective length of the turnbuckle is reduced. Conversely, to decrease the curvature of the trim plate, the effective length of a turnbuckle is increased. Decreased curvature of the trim plate provides for a lesser downward force on the trim plate as identified by arrow 27 and as caused by the fluid pressure difference due to the flow of water relative to and rearwardly of the bottom surface of the trim plate. Thus, the degree of bow up or bow down attitude of the boat can be controlled by adjusting the curvature of each trim plate 16 and this is accomplished by adjusting the effective lengths of the turnbuckles 28. In this manner, boat 10 has a trimmable or an adjustable bottom which can provide a greater latitude of control of the boat for the boat operator at all speeds especially at high speed where a small adjustment of each power device 28 will cause a large change in the bow up or bow down attitude of the boat since the fluid force on the trim plate 16 is a function of the relative speed between the boat and the fluid, namely the water beneath the boat.

The number of power devices 28 for each trim plate can be selected as desired. For purposes of illustration, there are three such power devices for each trim plate 16, respectively, as shown in FIG. 3 but there could be more or fewer, if desired. The power devices are generally perpendicular to respective trim plates since the bottom of the boat is angled as shown in FIGS. 1*a* and 3. The trim plates are in position so as to not to interfere with the propeller 37 of the boat (FIG. 3).

FIG. 4 shows that the present invention can be used with a catamaran boat 40 having a pair of spaced side portions 42 and 44 and provided with trim plates 46 and 48 controlled by power devices 50 and 52, respectively. The bottoms of portions 42 and 44 of boat 40 are angled as shown in FIG. 4 and each trim plate 46 or 48 of the boat 40 will be curved in a manner shown in FIG. 2 to present a convex lower face which is an air foil-like surface for providing downward forces at the aft end of the boat 40. The magnitude of the force is controlled by varying the lengths of power devices 50 and 52.

While power devices 28 of FIG. 2 and power devices 50 and 52 of FIG. 4 had been described as being turnbuckles, they could be fluid-actuated piston and cylinder assemblies 54 as shown in FIG. 5. They could be electrical or hydraulic in operation, in addition to the manual operation of adjusting as such by turnbuckles. The boat could be rimmed by independently adjusting the power devices of one trim plate differently from the power devices of the other trim plate of the boat 10 or the boat 40. Thus, the present invention provides optimum flexibility in the operation or trimming of the boat for bow up or bow down attitudes thereof.

Another improvement of the present invention is the use of a spoiler 60 on the aft end of a trim plate 62 of a boat 59, the trim plate being substantially the same in construction, operation and purpose as trim plate 16 of boat 10 (FIGS. 1–3). Trim plate 62 is adjusted in curvature by a power device 54 which, for purposes of illustration, includes a fluid piston and cylinder assembly supplied by fluid under pressure, such as hydraulic fluid at ports 66 and 68. A control for controlling the flow of fluid to and from the device 64 is on board the boat at some suitable location. The trim plate 62 is secured by fasteners 69 as described above with respect to trim plate 16 and fasteners 23. A recess 71 is above the trim plate 62.

Spoiler 60 includes a rigid bar 63 having a cylindrical outer surface 64 and provided with a pair of end faces 66 which are pivotally coupled by pins 68 to fingers 70 secured to and extending rearwardly from the aft end of the corresponding trim plate 62. Typically, there will be two trim plates 62 in the manner shown in FIG. 3 for boat 59. As such, each trim plate 62 will have a spoiler 60 thereon. The spoiler will extend across substantially the entire width of the rear extremity of the trim plate.

The normal position of each spoiler 60 is as shown in FIG. 5 with the surface 64 above the lower rear, aft tip or extremity of the trim plate 62. This allows the stream lines 72 to provide a lamina flow of water relative to and past the convex surface of trim plate 62 so that the trim plate will act as an air foil-like surface creating a downward force of a sufficient magnitude depending upon the speed of the boat and the position of the power device 64 so as to create a nose up attitude for the boat.

If it is desired to provide instant control of the trim plate surface, the spoiler 60 is rotated in a counterclockwise sense when viewing FIG. 5 so that it is in the path of the streamlines as shown in FIG. 7, creating turbulence in the vicinity of the spoiler and thereby destroying laminar flow of the streamlines 72. This will reduce or substantially eliminate any downward force caused by the air foil effect of the curvature of the lower surface of the trim plate 62. This effect of the spoiler 60 can be applied for a short time or a relatively long time depending upon the desired attitude of the bow of the boat. The rotation of spoiler 60 can be done in any suitable manner, such as by manual operation of a lever 74 in the boat, the lever being operable to pull a cable 76 upwardly to rotate an arm 78 on the spoiler about the pivot axis of the spoiler.

When the effect of the spoiler is to be removed, spoiler 60 is rotated back into a position as shown in FIG. 5 by manipulation of lever 74 in the opposite direction. With the spoiler 60 in the position shown in FIG. 5, it will be out of the path of the stream lines 72 so that the air foil effect created by the convex shape of the downward lower surface of trim plate 62 will once again be created to again provide control of the attitude of the bow of the boat.

The present invention, therefore, provides a boat having trimmable or adjustable bottom which can be manually adjustable before the boat is moved through the water to which can be adjusted while the boat is underway during cruise or high speed operation. The invention is suitable for application to many types of boats and the invention is simple and rugged in construction, is inexpensive to produce and maintain, and can be used by inexperienced boat operators to provide greater flexibility in the operation of the boats.

I claim:

1. In a boat having a bottom and a transom, the improvement including a resilient trim plate having a forward end and an aft end, at least a part of the bottom surface of the trim plate being generally convex;

means for rigidly securing the forward end of the trim plate to said bottom at a first location spaced forwardly of the transom, said trim plate adapted to extend rearwardly of said location to a second location adjacent to the transom, there being a space between the upper surface of the trim plate and the adjacent lower surface of the boat when the trim plate is secured to said bottom, whereby the aft end of the trim plate is free to move through a limited distance in cantilever fashion in said space; and means coupled to the trim plate near the aft portion thereof, and adapted to be connected to the transom for adjusting said aft end upwardly and downwardly to change the curvature of the bottom surface of the trim plate.

2. In a boat as set forth in claim 1, wherein the convex lower surface of the trim plate extends from near the forward end of the trim plate to near the rear end of the trim plate.

3. In a boat as set forth in claim 1, wherein the forward end of the trim plate has a lower surface adapted to be placed in flush, coextensive relationship to the adjacent bottom surface portion of the boat.

4. In a boat as set forth in claim 1, wherein the trim plate is a rectangular, resilient member provided with a pair of opposed sides, a forward margin and an aft margin, the trim plate near the aft margin thereof having a convex lower surface portion.

5. In combination:

a boat having a bottom and a transom;

a resilient trim plate having a forward portion and an aft portion, at least a part of the bottom surface of the trim plate being generally convex;

means for rigidly securing the forward portion of the trim plate to said bottom at a location spaced forwardly of the transom, said trim plate extending rearwardly to a location adjacent to the transom, there being a space between the upper surface of the trim plate and the adjacent lower surface of the boat, whereby the trim plate is free to move through a limited distance in cantilever fashion in said space; and means coupled to the trim plate near the aft portion thereof and to the transom for adjusting said aft portion upwardly and downwardly to change the curvature of the bottom surface of the trim plate.

6. The combination as set forth in claim 5, wherein the convex lower surface of the trim plate extends from near the forward end of the trim plate to near the rear end of the trim plate.

7. The combination as set forth in claim 5, wherein the forward end of the trim plate has a lower surface adapted to be placed in flush, coextensive relationship to the adjacent bottom surface portion of the boat.

8. The combination as set forth in claim 5, wherein the trim plate is a rectangular, resilient member provided with a pair of opposed sides, a forward margin and an aft margin.

9. The combination as set forth in claim 5, wherein said bottom of the boat has a pair of sloping surfaces, there being a curved trim plate for each of aid sloping surface, respectively, and means coupled with each trim plate, respectively, for adjusting the aft portion thereof upwardly an downwardly to change the curvature of the bottom surface of the trim plate.

10. The combination as set forth in claim 5, wherein is included a shiftable spoiler shiftably coupled to the trim plate for movement into and out of the flow of water beneath the trim plate, and means in the boat for adjustably moving the spoiler.

* * * * *

UNITED STATES PATENT AND TRADEMARK OFFICE

CERTIFICATE OF CORRECTION

PATENT NO. : 4,909,175

DATED : March 20, 1990

INVENTOR(S) : HOWARD M. ARNESON

It is certified that error appears in the above-identified patent and that said Letters Patent is hereby corrected as shown below:

Title page:

Change line [19] on the title page to read as follows:

UNITED STATES PATENT [19]
Arneson

Change line [76] on the title page to read:

[76] Inventor: Howard M. Arneson, 18 Sagebrush

Signed and Sealed this

Fifteenth Day of October, 1991

*Attest:*

*Attesting Officer*

HARRY F. MANBECK, JR.

*Commissioner of Patents and Trademarks*